US008746859B2

(12) United States Patent
Bibl

(10) Patent No.: US 8,746,859 B2
(45) **Date of Patent: *Jun. 10, 2014**

(54) FLUID CIRCULATION

(71) Applicant: Fujifilm Dimatix, Inc., Lebanon, NH (US)

(72) Inventor: Andreas Bibl, Los Altos, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/923,185

(22) Filed: Jun. 20, 2013

(65) Prior Publication Data

US 2013/0278688 A1 Oct. 24, 2013

Related U.S. Application Data

(63) Continuation of application No. 13/022,063, filed on Feb. 7, 2011, now Pat. No. 8,517,522.

(51) Int. Cl.
*B41J 2/175* (2006.01)

(52) U.S. Cl.
CPC ..... *B41J 2/17513* (2013.01); *B41J 2/17553* (2013.01)
USPC ..... 347/85

(58) Field of Classification Search
CPC ..... B41J 2/17513; B41J 2/17556; B41J 2/17596; B41J 2/17553; B41J 2/18
USPC ..... 347/6, 7, 84–86
See application file for complete search history.

(56) References Cited

U.S. PATENT DOCUMENTS 4,891,654 A 1/1990 Hoisington et al.
5,771,052 A 6/1998 Hine et al.

(Continued)

FOREIGN PATENT DOCUMENTS

JP 10-114081 A 5/1998
JP 2009-101516 A 5/2009

(Continued)

OTHER PUBLICATIONS

International Search Report and Written Opinion for PCT/US2012/023478 mailed Sep. 3, 2012, 9 pages.

*Primary Examiner* — An Do
(74) *Attorney, Agent, or Firm* — Fish & Richardson P.C.

(57) ABSTRACT

Among other things, an apparatus for use in fluid jetting is described. The apparatus comprises a printhead including a flow path and a nozzle in communication with the flow path that has a first end and a second end. The apparatus also includes a first container fluidically coupled to the first end of the flow path, a second container fluidically coupled to the second end of the flow path, and a controller. The first container has a first controllable internal pressure and the second container has a second controllable internal pressure. The controller controls the first internal pressure and the second internal pressure to have a fluid flow between the first container and the second container through the flow path in the printhead according to a first mode and a second mode. In either mode, at least a portion of the fluid flowing along the flow path is delivered to the nozzle when the nozzle is jetting. The first mode has the first internal pressure higher than the second internal pressure and the second mode has the second internal pressure higher than the first internal pressure. The fluid flows from the first container to the second container according to the first mode and flows from the second container to the first container according to the second mode.

13 Claims, 9 Drawing Sheets

(56) References Cited

U.S. PATENT DOCUMENTS

| | | | | |
|---|---|---|---|---|
| 6,357,867 | B1 | 3/2002 | Hine | |
| 7,128,406 | B2 | 10/2006 | Dixon et al. | |
| 7,413,300 | B2 | 8/2008 | Von Essen et al. | |
| 7,631,962 | B2 | 12/2009 | Bibl et al. | |
| 8,215,757 | B2 | 7/2012 | Kuribayashi et al. | |
| 8,366,224 | B2 | 2/2013 | Yokota et al. | |
| 8,517,522 | B2 * | 8/2013 | Bibl | 347/85 |
| 2009/0051722 | A1 | 2/2009 | Kaiho | |
| 2011/0007117 | A1 | 1/2011 | Bibl et al. | |
| 2011/0128335 | A1 | 6/2011 | von Essen et al. | |
| 2012/0200619 | A1 | 8/2012 | Bibl | |

FOREIGN PATENT DOCUMENTS

| | | | |
|---|---|---|---|
| JP | 2010-228350 | A | 10/2010 |
| WO | WO 2009/142889 | | 11/2009 |
| WO | WO 2009/143362 | | 11/2009 |

* cited by examiner

FLUID CIRCULATION

CROSS-REFERENCE TO RELATED APPLICATIONS

This application is a continuation application of and claims priority to U.S. application Ser. No. 13/022,063, filed on Feb. 7, 2011, now issued as U.S. Pat. No. 8,517,522.

TECHNICAL FIELD

This disclosure generally relates to fluid circulation in a fluid ejector.

BACKGROUND

An ink jet printer typically includes an ink path from an ink supply to an ink nozzle assembly that includes nozzles from which ink drops are ejected. Ink drop ejection can be controlled by pressurizing ink in the ink path with an actuator, which may be, for example, a piezoelectric deflector, a thermal bubble jet generator, or an electrostatically deflected element. A typical printhead has a line of nozzles with a corresponding array of ink paths and associated actuators, and drop ejection from each nozzle can be independently controlled. In a so-called "drop-on-demand" printhead, each actuator is fired to selectively eject a drop at a specific pixel location of an image, as the printhead and a printing media are moved relative to one another.

A printhead can include a semiconductor printhead body and a piezoelectric actuator. The printhead body can be made of silicon, which is etched to define ink chambers. Nozzles can be formed in the silicon body, or defined by a separate nozzle plate that is attached to the silicon body. The piezoelectric actuator can have a layer of piezoelectric material that changes geometry, or bends, in response to an applied voltage. The bending of the piezoelectric layer pressurizes ink in a pumping chamber located along the ink path.

Printing accuracy can be influenced by a number of factors, including the uniformity in size and velocity of ink drops ejected by the nozzles in the printhead and among the multiple printheads in a printer. The drop size and drop velocity uniformity are in turn influenced by factors, such as the dimensional uniformity of the ink paths, acoustic interference effects, contamination in the ink flow paths, and the uniformity of the pressure pulse generated by the actuators. Contamination or debris in the ink flow can be reduced with the use of one or more filters in the ink flow path.

SUMMARY

In one aspect, the disclosure describes an apparatus for use in fluid jetting. The apparatus comprises a printhead including a flow path and a nozzle in communication with the flow path. The flow path has a first end and a second end. The apparatus also includes a first container fluidically coupled to the first end of the flow path, a second container fluidically coupled to the second end of the flow path, and a controller. The first container has a first controllable internal pressure and the second container has a second controllable internal pressure. The controller controls the first internal pressure and the second internal pressure to have a fluid flow between the first container and the second container through the flow path in the printhead according to a first mode and a second mode. In either mode, at least a portion of the fluid flowing along the flow path is delivered to the nozzle when the nozzle is jetting. The first mode has the first internal pressure higher than the second internal pressure and the second mode has the second internal pressure higher than the first internal pressure. The fluid flows from the first container to the second container according to the first mode and flows from the second container to the first container according to the second mode.

Implementations may include one or more of the following features. The fluid flowing from the first container to the nozzle in a direction opposite to the direction in which the fluid flows from the second container to the nozzle. The first internal pressure and the second internal pressure are both lower than the atmospheric pressure. A difference between the first and second internal pressures is larger than a difference between the atmospheric pressure and the first or second internal pressure. The controller controls a rate of the fluid flow between the first and second containers to be higher than the rate of the fluid delivery from the first or second container to the nozzle when the nozzle is jetting. For a given period of time, an amount of the fluid flown between the first and second containers is at least 10 times an amount of fluid jetted by the printhead when the printhead is jetting a fluid. A rate of the fluid flow through the flow path is about 5% or less of a velocity of a fluid droplet ejected from the nozzle. The apparatus also includes a sensor to sense a fluid level in each of the first container and the second container. The controller controls the first and second internal pressures to be in the first mode when the sensed fluid level in the second container is below a predetermined value. The controller controls the first and second internal pressures to be in the second mode when the sensed fluid level in the first container is below a predetermined value. The first container is in a first chamber and the second container is in a second chamber, and the first and second containers are flexible and contain substantially no air. Each of the first and second chambers is connected to a vacuum source to provide adjustment to the first and second internal pressures. The flow path is about 1 micron to about 30 microns upstream of the nozzle, e.g., measured along a path in which the fluid flows. The first and second containers are self-contained fluid reservoirs. The first and second containers are mounted on a housing that is connectable to the printhead. The connection between the housing and the printhead is switchable between a first state in which the first and second containers are in fluid communication with the flow path and a second state in which the first and second containers are fluidically disconnected from the flow path.

In another aspect, the disclosure features a method for use in fluid jetting. The method comprises delivering a fluid at a controlled flow rate from a first container to a second container along a flow path in a printhead along a first direction and delivering the fluid at a controlled flow rate from the second container to the first container along the flow path in the printhead along a second direction opposite to the first direction. A portion of the fluid flowing in the flow path is delivered to a nozzle in communication with the flow path when the nozzle is ejecting the fluid. A portion of the fluid flowing in the flow path is delivered to the nozzle in communication with the flow path when the nozzle is ejecting the fluid.

Implementations may include one or more of the following features. The fluid flowing from the first container to the nozzle in a direction opposite to the direction in which the fluid flows from the second container to the nozzle. A pressure difference between an internal pressure of the first container and an internal pressure of the second container is maintained. Each internal pressure of the first and second containers is maintained to be lower than an atmospheric pressure. The pressure difference between either internal pressure of the first and the second containers and the atmospheric pressure is maintained to be smaller than the pressure difference between the internal pressure of the first container and the internal pressure of the second container. The first and second containers are flexible and the pressure difference is maintained by applying different pressures to exterior surfaces of the flexible first and second containers. A fluid level in the first and second containers is sensed and a fluid delivery direction from the first and second directions is selected based on the sensed fluid level. Delivering the fluid in the selected direction comprises adjusting the internal pressures of the first and second containers. The controlled flow rate is about 5% or less of a velocity of a fluid droplet ejected by the nozzle.

In another aspect, the disclosure features an apparatus for use in fluid jetting. The apparatus comprises a printhead including a flow path and a nozzle in communication with the flow path, the flow path having a first end and a second end; a first container fluidically coupled to the first end of the flow path, the first container having a first controllable internal pressure; a second container fluidically coupled to the second end of the flow path, the second container having a second controllable internal pressure; and a controller to control the first internal pressure and the second internal pressure to have a fluid flow between the first container and the second container through the flow path in the printhead. At least a portion of the fluid flowing along the flow path is delivered to the nozzle when the nozzle is jetting, the first internal pressure being higher than the second internal pressure.

Implementations may include one or more of the following features. The fluid flowing from the first container to the nozzle in a direction opposite to the direction in which the fluid flows from the second container to the nozzle. The first internal pressure and the second internal pressure are both lower than atmospheric pressure. The first container is in a first chamber and the second container is in a second chamber, and the first and second containers are flexible and contain substantially no air each of the first and second chambers is connected to a vacuum source to provide adjustment to the first and second internal pressures. The first and second containers are self-contained fluid reservoirs. The first container contains the fluid and the second container is empty before use.

Implementations may include one or more of the following advantages. An assembly having a printhead module attached to a cartridge containing self-contained fluids can be used for testing operations, such as test printing. The cartridge can include two separate chambers each enclosing a fluid container capable of providing the fluid to nozzles of the printhead module to be jetted. The fluid can be recirculated between the two fluid containers to prevent the fluid from drying along one or more fluid paths in the system or at the nozzles. Particles in fluid can be kept in suspension in the fluid to maintain the quality of the fluid. For example, the fluid can have a high uniformity. Further, air bubbles along the fluid paths can be removed by the recirculation flow. The fluid recirculation can be performed during the fluid jetting. The entire assembly can be disposed of following the testing operation, avoiding having to flush clean a printhead module between tests.

Details of one or more implementations are set forth in the accompanying drawings and the description below. Other features and advantages may be apparent from the description and drawings, and from the claims.

DETAILED DESCRIPTION

A printhead module generally includes a printhead body with multiple nozzles that are in fluid communication with an external fluid supply to allow for a continuous printing operation. In certain applications, a printhead module that can be effectively operated using a relatively small volume of a fluid, e.g., for a fluid testing operation, is desirable. The printhead module can include a fluid supply assembly designed for a relatively small volume of a printing fluid, and the fluid supply assembly can be attachable to the printhead body. In some implementations, the fluid supply assembly is a non-refillable fluid supply assembly, e.g., a single-use printing fluid supply cartridge. Such a device is described in U.S. Pat. No. 7,631,962, which is incorporated by reference.

After use, the printhead body and the fluid supply assembly can be discarded. For example, when testing printing fluids of different colors or qualities, each type of fluid is contained within a fluid supply assembly and printed using a printhead body that is not used to print any other types of printing fluids. There would be no need to flush clean the fluid supply assembly or the printhead body when testing different printing fluids.

Figure 1:
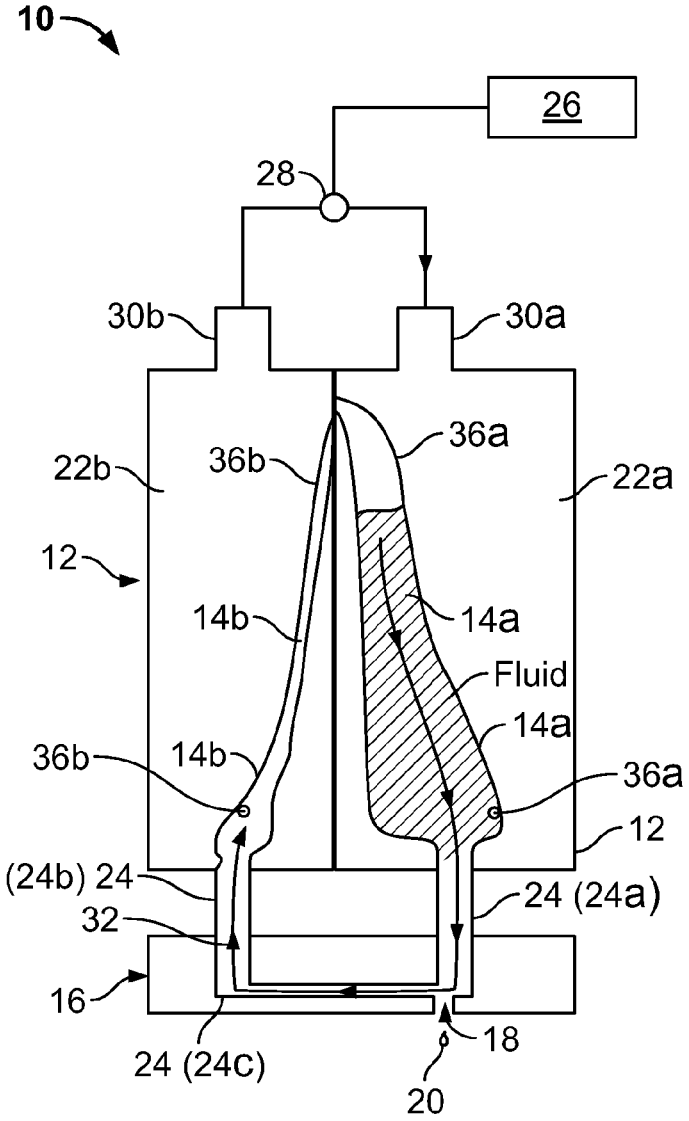
FIG. 1 is a schematic diagram of a printing system.

Referring to FIG. 1, an assembled system 10 (or a printhead module 10) for use, e.g., in test printing, includes a printhead body 16 and a fluid supply assembly 12, e.g., in the form of a cartridge 12 that can be attached to the printhead body 16. The fluid supply assembly 12 contains two fluid containers 14*a*, 14*b* to supply a fluid to a printhead body 16. One or more nozzles 18 (only one nozzle shown in the figure) of the printhead body 16 can be activated to eject fluid drops 20 to form a pattern on a substrate (not shown). The pattern can be studied to evaluate the quality of the fluid, the image effect of the printing, or the design of the printhead module 16.

The two fluid containers 14*a*, 14*b* each can be a self-contained fluid reservoir that communicates with each other through a fluid path 24 extending from each fluid container 14*a*, 14*b*, and passing through the printhead body 16. In this context, self-contained means that during the printing operation, fluid is not supplied into the reservoir from a source outside the fluid containers 14*a*, 14*b*. Rather, the fluid to be used is the fluid contained within the self-contained fluid containers 14*a*, 14*b*. For convenience, we name the fluid path 24 from the fluid container 14*a* and outside the printhead module 16 as 24*a*, the fluid path 24 from the fluid container 14*b* and outside the printhead module 16 as 24*b*, and the fluid path 24 within the printhead module as 24*c*. The fluid path 24*c* can be formed in an MEMS die (see FIGS. 5 and 6 below) and is upstream of the nozzle 18. The fluid can flow back and forth through the flow path 24 between the two fluid containers 14*a*, 14*b* to recirculate the fluid between the two containers. During the flow, a portion of the fluid is directed to the nozzle 18 when needed, e.g., when fluid droplets 20 are being jetted. The fluid to be jetted by the printhead module 16 can be delivered from either of the fluid containers 14*a*, 14*b*.

The recirculation (or circulation) of the fluid between the two containers 14*a*, 14*b* can improve printing quality, e.g., by preventing the fluid from drying at any location along the fluid path or approximate the nozzle 18. Particles in the fluid can be kept in suspension in the fluid without substantial coagulation to maintain the quality, e.g., uniformity of viscosity and/or avoidance of large particles that could clog the fluid path or nozzle, of the fluid. In some implementations, air bubbles generated along the fluid path 24 can be carried with the flow and be removed at the containers 14*a*, 14*b*, e.g., by rising to the surface of the fluid in the containers 14*a*, 14*b*. The test printing results from the system 10 contain few artifacts generated by fluid drying, air bubbles, or fluid quality variations. The system 10 resembles a real printing system (that is not used only for testing), and the test printing results can provide a true representation of the elements that are being tested, e.g., the quality of the fluid.

In the assembled system 10, to prevent the fluid from automatically flowing out of an inactivated nozzle 18 and control the fluid flow between the containers 14*a*, 14*b* (explained in more detail below), the fluid pressure in each fluid container 14*a*, 14*b* is controlled. In the example shown in FIG. 1, the fluid containers 14*a*, 14*b* each includes a flexible wall 36*a*, 36*b* that transfers the pressure in each chamber 22*a*, 22*b* of the cartridge 12 to the fluid inside the containers 14*a*, 14*b*. Each chamber 22*a*, 22*b* encloses a respective fluid container 36*a*, 36*b*. The pressure within each chamber 22*a*, 22*b* can be adjusted using a pressure control device 28, e.g., one or more pumps or vacuum sources, connected to the chambers through openings 30*a*, 30*b*, respectively. The chambers 22*a*, 22*b* are sealed from each other and the pressure in each chamber can be independently adjusted by the pressure control device 28.

In some implementations, the amount of fluid in the containers 14*a*, 14*b* is small and the fluid pressures within the containers 14*a*, 14*b* are substantially the same as the fluid pressures in the chambers 22*a*, 22*b*, respectively. Each container 14*a*, 14*b* can be air-free or under a vacuum before the fluid is filled into the container. In some implementations, a system 10 can have one of the fluid containers 14*a*, 14*b* filled with a desired amount of fluid, e.g., 0.25 ml to 10 ml, 0.5 ml to 3 ml, or 1.5 ml, and the other one of the fluid containers empty and airless. In some implementations, the fluid containers 14*a*, 14*b* may contain some air. In some implementations, the fluid containers contain a gas but do not contain oxygen gas. The fluid path 24 can be controlled to be airless or free of oxygen. An airless system or a system free of oxygen can prevent air or oxygen dissolving into the fluid to affect the quality of printing or quality of the fluid. In some implementations, the system 10 can be assembled under an inert atmosphere.

Figure 1A:
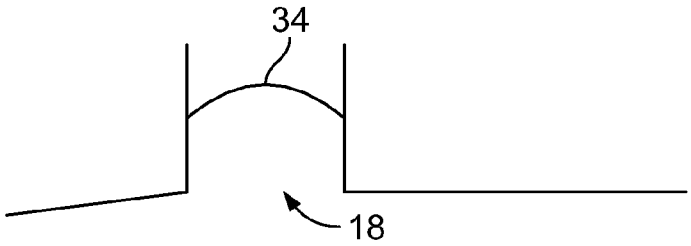
FIG. 1A is a schematic diagram of a fluid meniscus in a nozzle.

The fluid in each containers 14*a*, 14*b* is maintained at a selected negative pressure, e.g., −0.5 inch of water to −20 inches of water or −6 inches to −7 inches of water, depending on factors such as size of the orifice or nozzle 18. When the nozzle 18 is not activated to eject droplets 20, the negative pressure prevents the fluid from automatically seeping out of the nozzle 18 and at the same time prevents air from being drawn into the printhead module 16 from the nozzle 18. Referring to FIGS. 1 and 1A, the negative pressure in the fluid balances the combined forces of fluid source pressure (produced by the height location of the fluid containers 14*a*, 14*b* relative to the printhead module 16, which can be positive or negative), capillary action, and atmospheric pressure to maintain a meniscus 34 on an fluid-air interface at the nozzle 18. When the nozzle 18 (or the pumping chamber) is activated, the meniscus 34 can allow the fluid to be jetted out of the nozzle 18 readily. Such a negative pressure in the fluid is maintained during the flow circulation between the containers 14*a*, 14*b*, and also during fluid jetting from the nozzle 18. During fluid jetting, the fluid pressure in the vicinity of the nozzle 18 (e.g., upstream of the nozzle 18 and in a pumping chamber (not shown)) can be changed by an actuator, e.g., a piezoelectric actuator.

The direction of fluid flow along the fluid path 24 is controlled by a difference between the fluid pressures in the fluid containers 14*a*, 14*b*. For example, when the fluid pressure in the container 14*a* is higher than the fluid pressure in the container 14*b*, the fluid flows from the container 14*a* towards the container 14*b* (as an arrow 32 shows). The pressure control device 28 maintains the negative pressure in the fluid (in the containers 14*a*, 14*b* or at the printhead body 16) and, e.g., at the same time, generates the pressure difference between the pressures within the chambers 22*a*, 22*b*. The rate of the fluid flow can be affected by the value of the pressure difference and other factors, such as the dimensions of the flow path 24.

The amount of recirculation fluid between the two fluid containers can be about 1/1000 to about 10 times the maximum amount of fluid jetted by the print body 16 in a given time period. The recirculation fluid flow rate (i.e., the amount of recirculation fluid passing by a cross-section of the flow path 24 per second) can be selected based on the need of the system. In some implementations, the ratio of the recirculation fluid flow rate to the amount of fluid jetted depends on the duty cycle of the printing or percentage of the jetting nozzles per unit time period, e.g., be lower when the printing is operating at a higher duty cycle. The recirculation fluid flow velocity can be controlled to prevent effects on, e.g., errors in, fluid jetting trajectories because the recirculation fluid is in communication with the nozzle 18, e.g., flows past the nozzle 18.

The value of the pressure difference between the two fluid containers can be chosen based on the desired flow rate, the characteristics of the fluid, e.g., viscosity, the design of the flow path 24, and other factors. In some implementations, the value of the pressure difference is pre-chosen based on the assembly 10 and the fluid while the direction of the pressure difference can be changed dynamically. The assembly 10 switches the direction of the pressure difference to drive the fluid flow in the desired direction. For example, when the pressure in the fluid container 14*a* is higher than the fluid pressure in the fluid container 14*b*, the fluid flows from the fluid container 14*a* to the fluid container 14*b*. When the direction of the pressure difference is reversed (i.e., the fluid container 14*b* has a higher pressure than the fluid container 14*a*), the flow direction is reversed. In some implementations, the value of the pressure difference is about 0.1 inch of water up to 100 inches of water.

A controller 26 determines the direction of fluid flow based on the fluid levels in each container 14*a*, 14*b*, and instructs the pressure control device 28 to form a desired pressure difference between the two containers to drive the fluid flow. In some implementations, the fluid levels are sensed by fluid level sensors 36*a*, 36*b* located within the containers 14*a*, 14*b*, respectively. Examples of the sensors 36*a*, 36*b* can include contact sensors that touch the fluid containers 14*a*, 14*b*. Other sensors (not shown) suitable for use can include optical sensors, which can be placed outside of the containers 14*a*, 14*b*, proximity sensors, or magnetic sensors, such as reed switches. The sensors 36*a*, 36*b* can communicate with the controller 26 through a wire (not shown) or wirelessly. In some implementations, the sensors 36*a*, 36*b* and the controller 26 are connected by one or more optical fibers for communication, e.g., data delivery.

Figure 2:
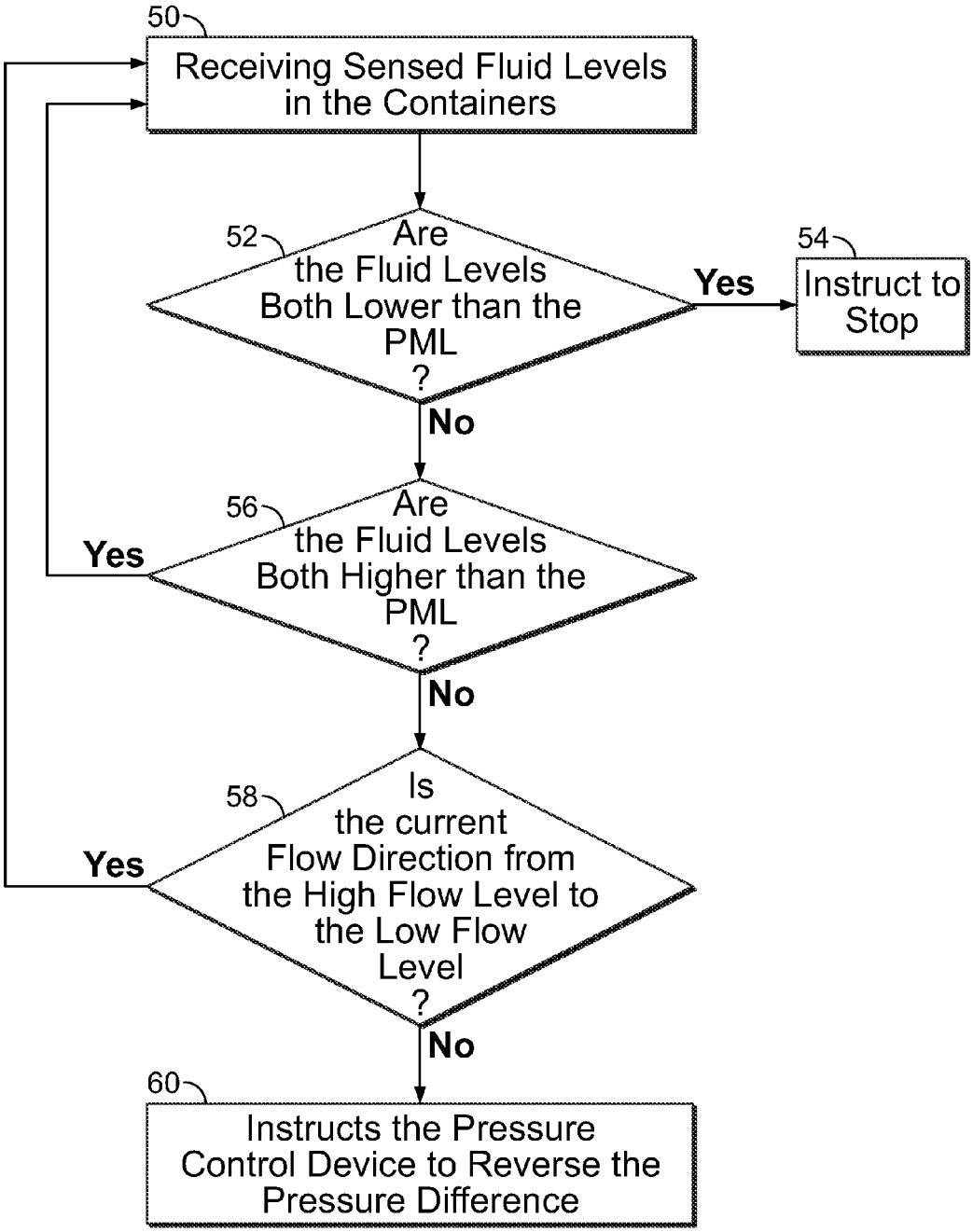
FIG. 2 is a flow diagram describing operations of a controller.

The controller 26 can be programmed to store criteria for use in forming the instructions to the pressure control device 28 or other associated devices, e.g., the printhead body 16, based on the sensed fluid levels in the containers 14*a*, 14*b*. For example, the criteria can be a minimum fluid level. Under some stored criteria, the controller 26 can function as shown in FIG. 2. Upon receiving 50 the sensed fluid levels in the containers 14*a*, 14*b* from the sensors 36*a*, 36*b*, the controller 26 compares the sensed fluid levels with the stored criteria. The controller 26 first determines 52 whether the sensed fluid levels in both containers 14*a*, 14*b* are both lower than a predetermined minimum level (PML). If yes, the controller 26 instructs 54 the printhead module 16 to stop printing because the sensed fluid levels indicate that the fluid in the containers 14*a*, 14*b* is running out. In addition, the controller 26 can also provide a signal to the user to indicate that the fluid level is low and the cartridge 12 may be discarded or needs to be refilled (discussed later). The pressure control device 28 can also be instructed to stop working, although maintaining the negative pressure for the fluid meniscus at the nozzle 18 may be desirable so that the fluid does not leak. If no, then the controller 26 determines 56 whether the sensed fluid levels are both higher than the predetermined minimum level. If yes, the fluid flow conditions, e.g., direction or rate, along the fluid path 24 between the two containers 14*a*, 14*b* do not need to be changed. The controller 26 keeps receiving 50 the sensed fluid levels and monitors the fluid flow. If no, the controller 26 further determines 58 whether the current flow direction in the fluid path 24 is from the container having the high flow level to the container having the low flow level. If yes, the fluid flow conditions do not need to be changed, and the controller 26 keeps receiving 50 the sensed fluid flow levels and monitors the fluid flow. If no, then the controller 26 instructs 60 the pressure control device 28 to reverse the pressure difference between the two containers 14*a*, 14*b* so that the fluid flow direction is reversed.

The controller 26 can also use other criteria and function in ways different from that described in FIG. 2 to control the fluid flow between the two containers 14*a*, 14*b*. The criteria can be set at the controller 26 when the system 10 is manufactured or can be set/reset by any user of the system 10. The criteria can be selected practically, e.g., how much fluid needs to be in the system 10 to allow the printhead body 16 to effectively print, or how much fluid is initially filled in the containers 14*a*, 14*b*. For example, when one of the fluid containers is fully filled, and the other one is partially filled, the criteria (e.g., the predetermined minimum level) have to be reasonably high because not all fluid in the full container can be circulated into the partially filled container. The predetermined minimum level can also be affected by the sensitivity and reliability of the sensors 36*a*, 36*b* for sensing the ink levels in the two containers 14*a*, 14*b*. Examples of the predetermined minimum level can be 0.1 ml to about 0.2 ml. The predetermined minimum level can also be a percentage, e.g., 5%-20%, of the total initial fluid amount in each container or in both containers.

The controller 26 can be implemented with circuitry, e.g., a programmable microcontroller, or other hardware, software, firmware, or combinations. The controller 26 can also communicate with a controller (not shown) controlling the fluid jetting of the printhead module 16. In some implementations, the controller 26 can control both the pressure control device 28 and the fluid jetting. The controllers can be powered by one or more batteries (not shown) in the system 10 and can coordinate to control the fluid jetting and the fluid flow for fluid recirculation, e.g., simultaneously. Fluid recirculation in a printhead is also discussed in U.S. Pat. No. 7,413,300, U.S. Pat. No. 5,771,052, U.S. Pat. No. 6,357,867, U.S. Pat. No. 4,891,654, U.S. Pat. No. 7,128,406, and U.S. patent application Ser. No. 12/992,587, the entire contents of which are incorporated herein by reference.

The system 10 can be implemented as an assembly 70 shown in FIGS. 3A-3D. The controller 26 and the pressure control device 28 can be separate from the assembly 70 and be attached to the openings 72*a*, 72*b*. The assembly 70 includes a fluid supply assembly 74 attached to a printhead housing 76. A printhead body 78 is connected to the printhead housing 76. The fluid supply assembly 74 includes two fluid containers 80*a*, 80*b* in two separate chambers 74*a*, 74*b* to supply a jetting fluid to the printhead body 78. The fluid supply assembly 74 can be similar to the cartridge 12 of FIG. 1, the fluid containers 80*a*, 80*b*, and the chambers 74*a*, 74*b* can have similar features to those of the fluid containers 14*a*, 14*b*, and the chambers 22*a*, 22*b*. The printhead body 78 can have features, e.g., flow path and nozzles, like the flow path 24*c* and the nozzles 18 of FIG. 1. Each chamber 74*a*, 74*b* includes an opening 72*a*, 72*b* to be connected to a pressure control device (such as the pressure control device 28 of FIG. 1). The fluid contained in the containers 74*a*, 74*b* is recirculated between the containers and supplied to the printhead body 78 in a manner, e.g., through flow paths 80*a*, 80*b*, similar to that described in FIG. 1.

Figure 3A:
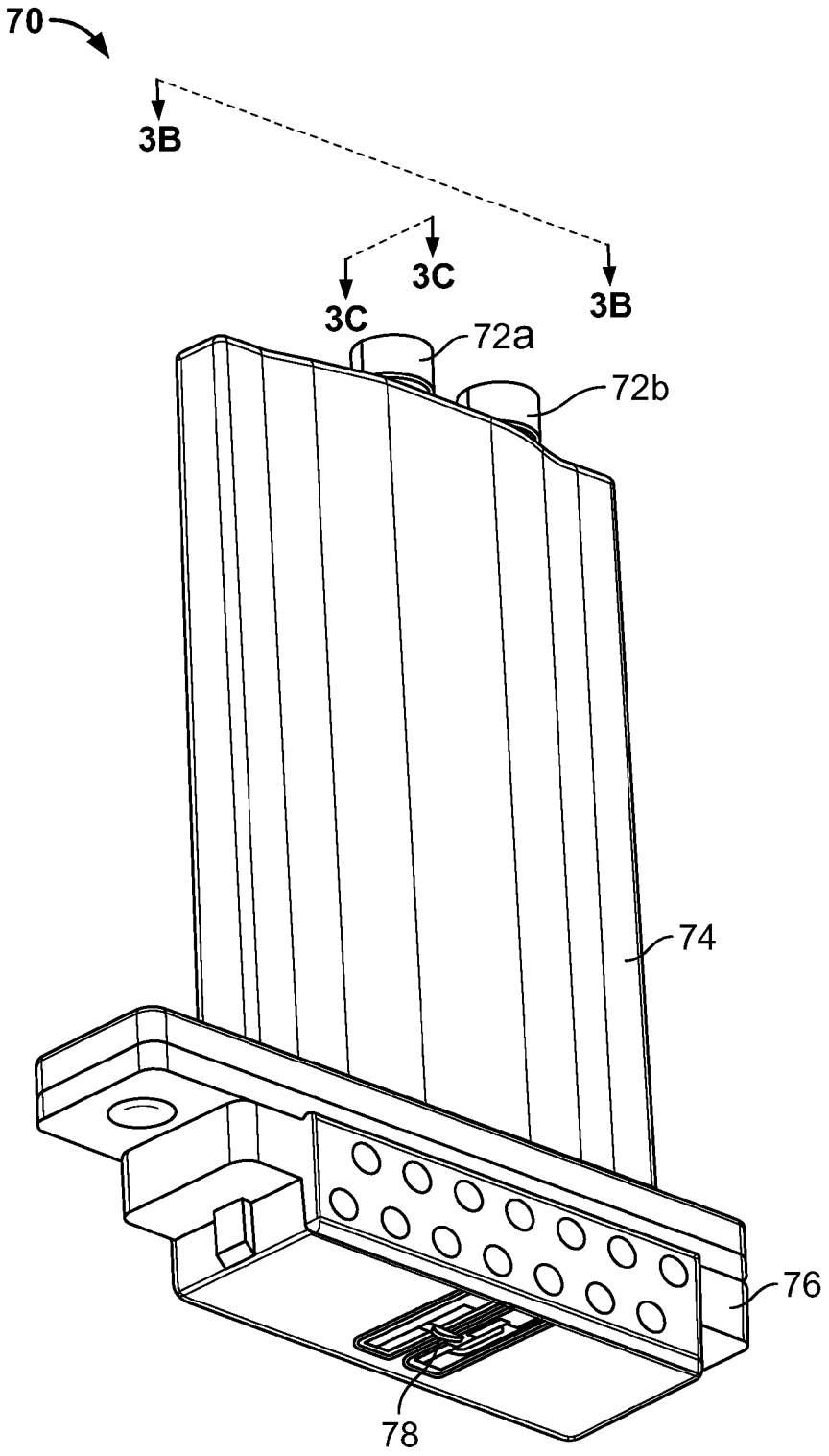
FIG. 3A is a perspective view of a printing system.
Figure 3B:
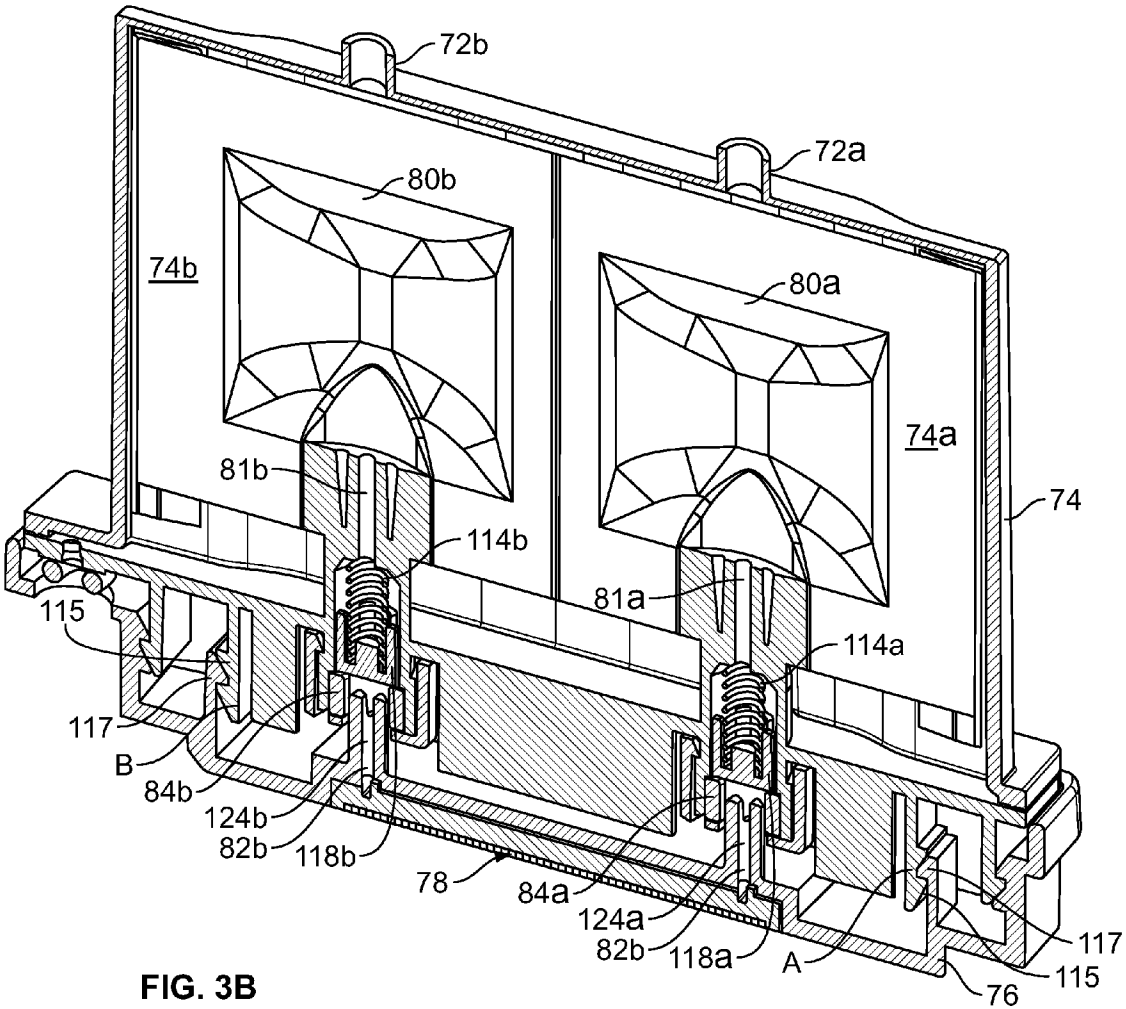
FIGS. 3B-3D are cross-sectional views of a printing system.
Figure 3C:
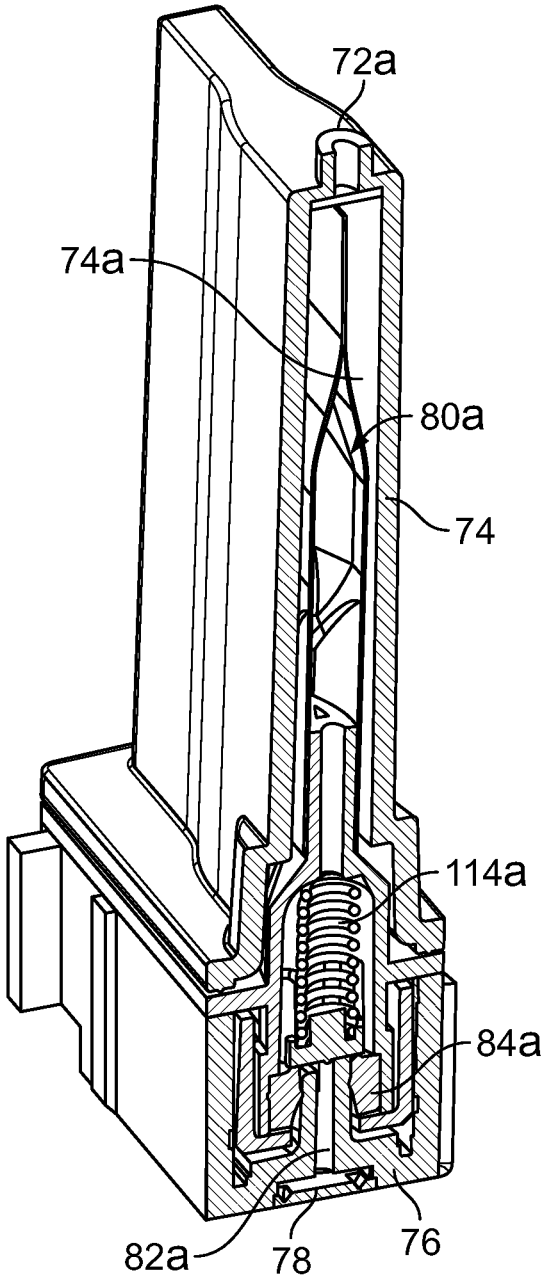
Figure 3D:
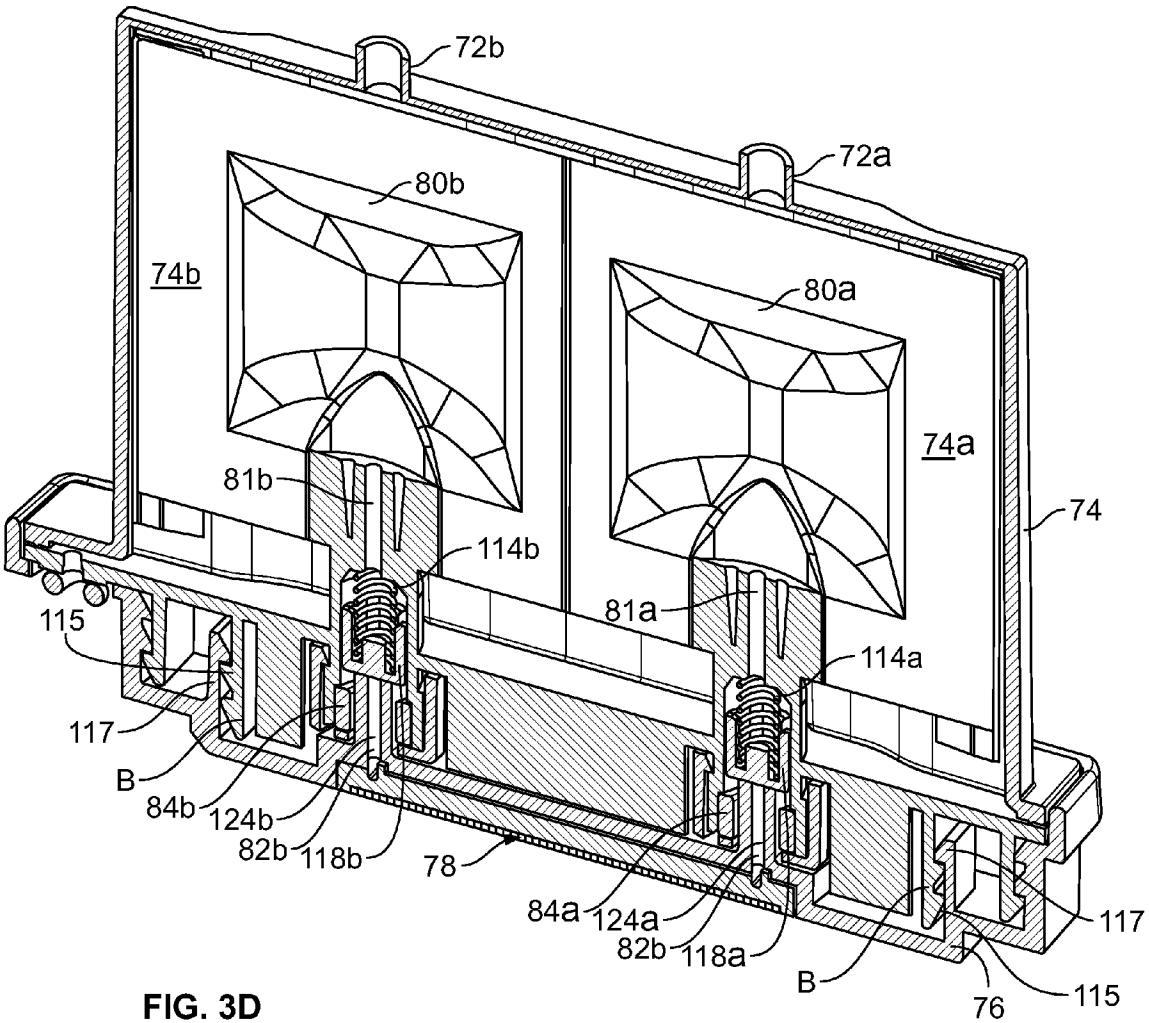

In particular, FIGS. 3B and 3D are cross-sectional perspective views of the assembly 70 depicted in FIG. 3A taken along line 3B-3B. FIG. 3C is a cross-sectional perspective view of the assembly 70 taken along line 3C-3C. The fluid supply assembly 74 includes the self-contained fluid containers 80*a*, 80*b*, at least one of which containing a small volume of a fluid, such as ink. Like the containers 14*a*, 14*b*, the fluid containers 80*a*, 80*b* are flexible containers, similar to bags, and shall be referred to as fluid bags, although other forms of self-contained fluid containers can be used. The fluid bags 80*a*, 80*b* can be filled with the fluid before or after the fluid supply assembly 74 is attached to the printhead housing 76. In some implementations, the total amount of fluid filled in the fluid bags 80*a*, 80*b* does not exceed the capacity of one fluid bag 80*a* or 80*b*. For example, the fluid bag 80*a* can be fully filled with the fluid while the fluid bag 80*b* is empty. In some implementations, up to about 75% of the total capacities of the two fluid bags 80*a*, 80*b* can be filled with the fluid. The unfilled capacity in either one or both of the fluid bags 80*a*, 80*b* provides room for the fluid to be recirculated between the two bags.

The fluid bags 80*a*, 80*b* can be sealed after the fluid is filled into the bags. The fluid remains in the fluid bags until it is used. Seals 84*a*, 84*b*, e.g., O-rings, form seals between the fluid bags 80*a*, 80*b* and the printhead housing 76. Referring particularly to FIGS. 3B and 3D, the embodiments depicted include a double snap-fit connection, whereby the fluid supply assembly 74 can be first attached to the printhead housing 76 in position A, the closed position (FIG. 3B). In the closed position, the fluid paths 82*a*, 82*b* are closed and the fluid bags 74*a*, 74*b* are not in fluid communication with the printhead body 78. Prior to commencing a printing operation, the fluid supply assembly 74 is moved into position B, the open position (FIG. 3D). In the open position, the fluid bags 74*a*, 74*b* are in fluid communication with the printhead body 78 via the open fluid paths 82*a*, 82*b*.

To connect the fluid supply assembly 74 to the printhead housing 76 in the closed position A, a user aligns the male connectors 115 protruding from the fluid supply assembly 74 with the corresponding female connectors 117 formed in the printhead housing 76 and exerts enough force to engage the male connectors 115 with the female connectors 117 at position A (FIG. 3B), but not too much force so as to engage the female connectors 117 at position B (FIG. 3D). The user should receive enough tactile feedback when mating the fluid supply assembly 74 to the printhead housing 76 to determine when position A has been reached.

To move the fluid supply assembly 74 into the open position B with respect to the printhead housing 76, a user exerts additional force to engage the male connectors 115 with the female connectors 117 at position B. The male connectors 115 have enough flexibility to bend under pressure to disengage from the female connectors 117 at position A and snap into engagement at position B. The female connectors 117 can be configured to facilitate this movement, for example, by having angled faces as depicted that encourage the similarly angled male connectors 115 to slide out of engagement upon the exertion from a downward force. The above describes one implementation of a double snap-fit connection. Other configurations of a double snap-fit connection can be used, as well as other types of connections that allow for a closed and an open position.

The fluid paths 82*a*, 82*b* are opened or closed based on the relative position of the fluid supply assembly 74 and the printhead housing 76. The fluid paths 82*a*, 82*b* include upper portions 81*a*, 81*b* within the fluid supply assembly 74 and extending from respective fluid bags 80*a*, 80*b*. The upper portions 81*a*, 81*b* ends at the bottom surfaces of outlet heads 118*a*, 118*b* of the fluid supply assembly 74. The fluid paths 82*a*, 82*b* also include lower portions 124*a*, 124*b* formed in the printhead housing 76. When the fluid supply assembly 74 is in the position A of FIG. 3B, the upper portions 81*a*, 81*b* and the lower portions 124*a*, 124*b* do not connect. Instead, the seal 84*a*, 84*b* are in contact with the bottom surface of the outlet heads 118*a*, 118*b* and close the flow paths 82*a*, 82*b*. A spring 114 in the outlet head 118 exerts a downward force compressing the seal 110. The fluid in the fluid bags 80*a*, 80*b* cannot flow past the bottom surface of the outlet heads 118*a*, 118*b*. When the fluid supply assembly 74 is in the position B of FIG. 3D, the bottom of the outlet heads 118*a*, 118*b* contact the lower portions 124*a*, 124*b*, which can compress the spring 114 within the outlet heads 118*a*, 118*b*. The seals 84*a*, 84*b* are positioned past the distal end of the lower portions 124*a*, 124*b* of the fluid paths 82*a*, 82*b* and are not in contact with the bottom of the outlet head 118. The flow paths 82*a*, 82*b* are no longer blocked by the seal 110. The fluid can thereby flow from the fluid bags 80*a*, 80*b* to the printhead body 78. Detailed designs of the fluid path to enable such flow control are discussed, e.g., in U.S. Pat. No. 7,631,962, the entire content of which is incorporated herein by reference.

In some implementations, the fluid supply assembly 74 is permanently attached to the printhead housing 76, i.e., cannot be detached without breaking a component of the assembly 74 or housing 76. Once the fluid contained within the fluid bags 80*a*, 80*b* has been used, the assembly 70 can be discarded. The fluid bags 80*a*, 80*b* are filled via the outlet heads 118*a*, 118*b* before attaching the fluid supply assembly 74 to the printhead housing 76. The assembly 70 thereby provides a self-contained disposable testing unit that uses only a small volume of test liquid. Because the assembly 70 is only used once, testing can occur without flushing clean printhead modules between tests.

The system 10 of FIG. 1 can also be implemented in assemblies different from those shown in FIGS. 3A-3D. For example, the control of the flow path 82*a*, 82*b* between the fluid bags 80*a*, 80*b* and the printhead body 78 (FIGS. 3A-3D) can be differently performed using different structures and/or mechanisms. Some sample structures are described in U.S. Pat. No. 7,631,962.

Figure 4:
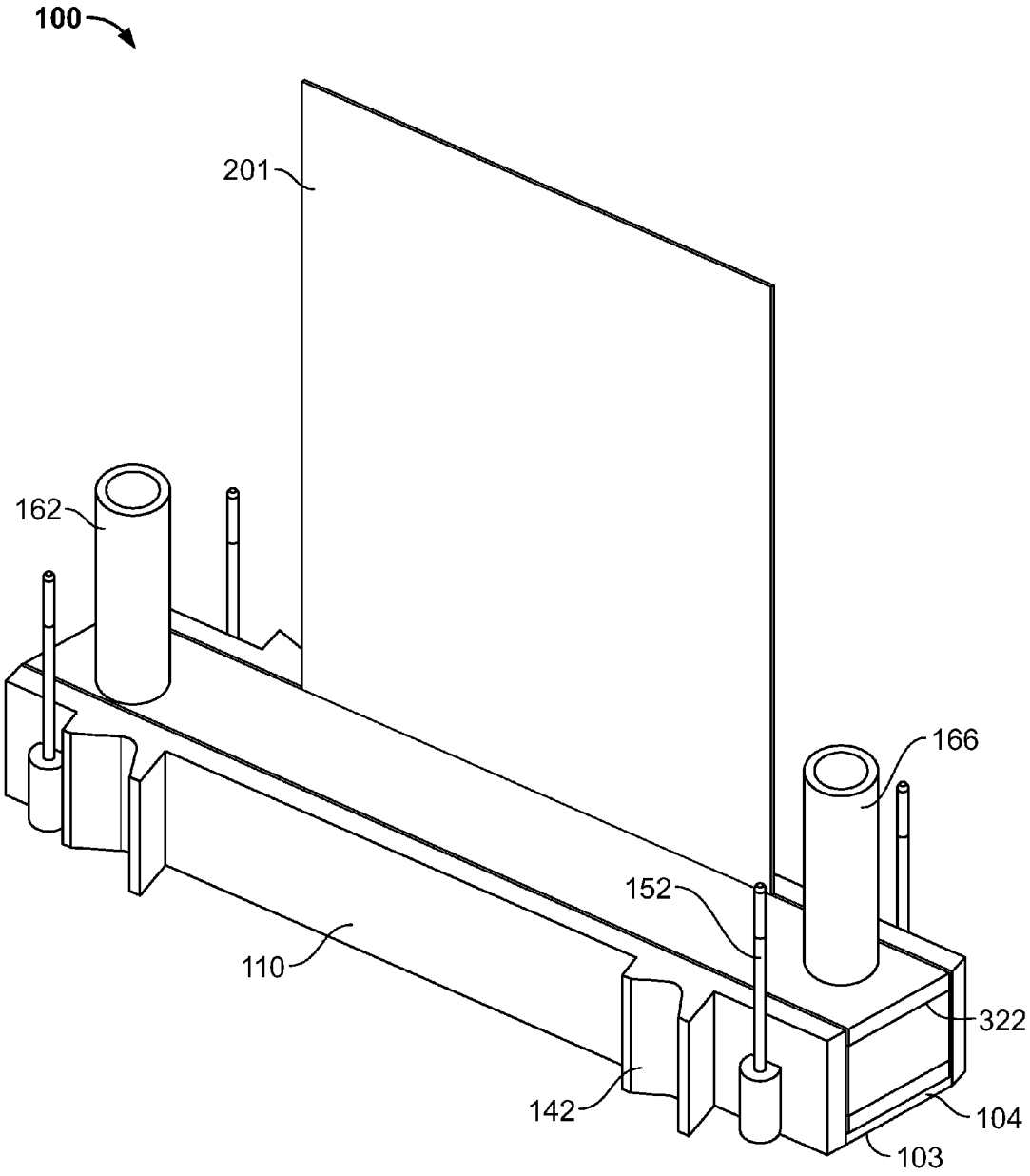
FIG. 4 is a schematic perspective view of a printhead body.

The printhead body 16 in the system 10 can be any type of printhead body. Referring to FIG. 4, a printhead body 100 includes a fluid ejection module, e.g., a quadrilateral plate-shaped printhead module, which can be a die 103 fabricated using semiconductor processing techniques. The fluid ejector further includes an integrated circuit interposer 104 over the die 103 and a lower housing 322 discussed further below. A housing 110 supports and surrounds the die 103, integrated circuit interposer 104, and lower housing 322 and can include a mounting frame 142 having pins 152 to connect the housing 110 to a print bar. A flex circuit 201 for receiving data from an external processor and providing drive signals to the die can be electrically connected to the die 103 and held in place by the housing 110. Tubing 162 and 166 can be part of the fluid paths 24*a*, 24*b* of FIG. 1 and are to be connected to the cartridge 12 of FIG. 1 to supply a fluid to the die 103.

Figure 5:
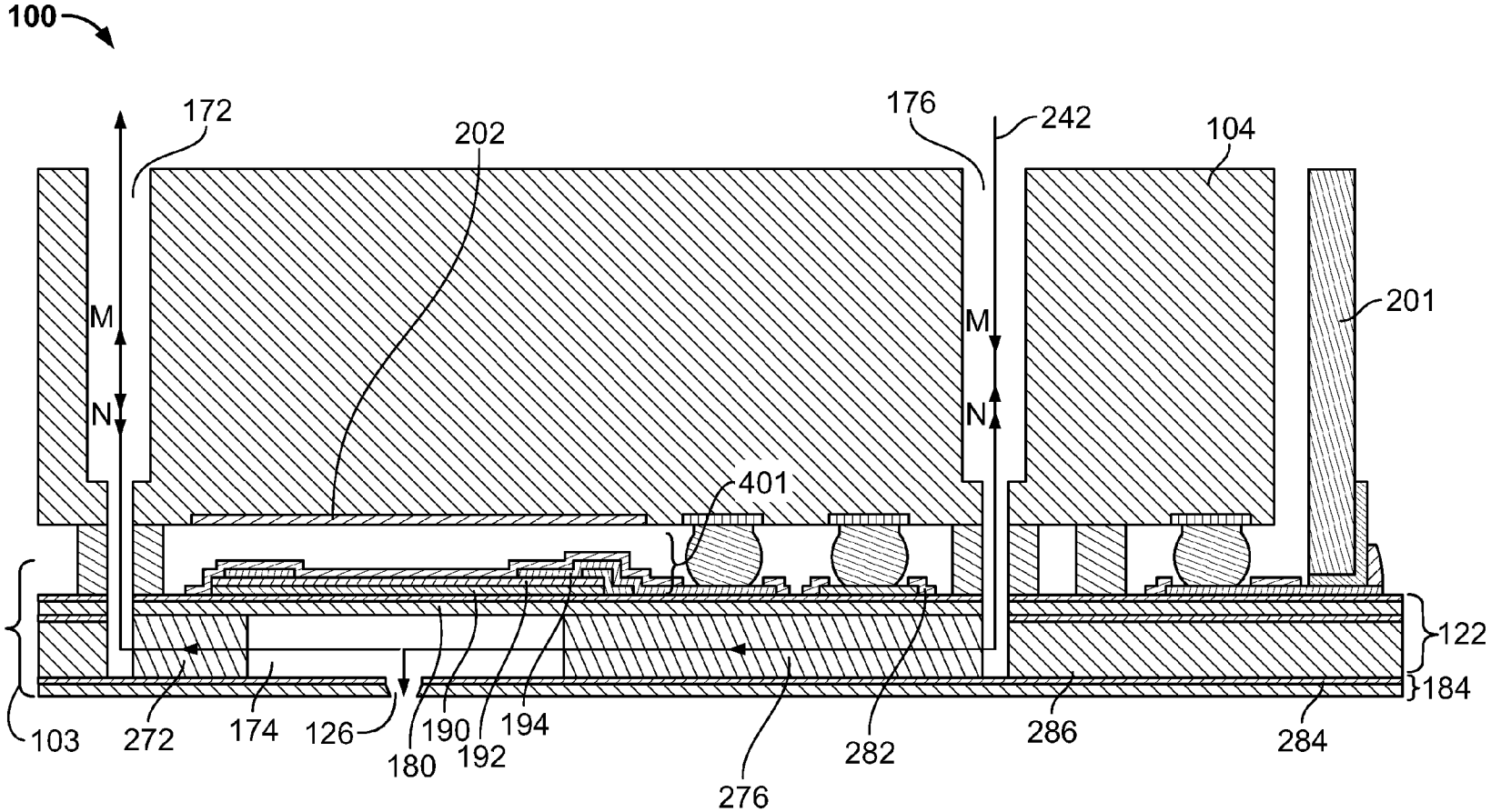
FIG. 5 is a cross-sectional view of a printhead body.

Referring to FIG. 5, the die 103 includes a substrate 122, e.g., a silicon-on-insulator (SOI) wafer and the integrated circuit interposer 104. Within the substrate 122, fluid paths 242 are formed to recirculate the fluid along the M direction (single arrow) or along the N direction (double arrow) between an inlet 176 and an outlet 172 (e.g., of the tubing 162, 166 of FIG. 4) while delivering the fluid to a pumping chamber 174 to be jetted from a nozzle 126. In implementations, the inlet 176 can be connected to the fluid container 14*a* and the outlet 172 can be connected to the fluid container 14*b* of FIG. 1. In the example shown in the figure, the pumping chamber 174 is part of the flow path 242. Each fluid path 242 includes an inlet channel 176 leading to the pumping chamber 174, and further to both the nozzle 126 and the outlet channel 172. The fluid path 242 further includes a pumping chamber inlet 276 and a pumping chamber outlet 272 that connect the pumping chamber 174 to the inlet channel 176 and outlet channel 172, respectively. The fluid path can be formed by semiconductor processing techniques, e.g., etching. In some embodiments, deep reactive ion etching is used to form straight walled features that extend part way or all the way through a layer in the die 103. In some embodiments, a silicon layer 286 adjacent to an insulating layer 284 is etched entirely through using the insulating layer as an etch stop. The pumping chamber 174 is sealed by a membrane 180 and can be actuated by an actuator formed on the surface of the membrane 180 opposite to the pumping chamber 174. The nozzle 126 is formed in a nozzle layer 184, which is on an opposite side of the pumping chamber 174 from the membrane 180. The membrane 180 can be formed of a single layer of silicon. Alternatively, the membrane 180 can include one or more layers of oxide or can be formed of aluminum oxide ($AlO_2$), nitride, or zirconium oxide ($ZrO_2$).

The actuators can be individually controllable actuators 401 supported by the substrate 122. Multiple actuators 401 are considered to form an actuator layer, where the actuators can be electrically and physically separated from one another but part of a layer, nonetheless. The substrate 122 includes an optional layer of insulating material 282, such as oxide, between the actuators and the membrane 180. When activated, the actuator causes the fluid to be selectively ejected from the nozzles 126 of corresponding fluid paths 242. Each flow path 242 with its associated actuator 401 provides an individually controllable MEMS fluid ejector unit. In some embodiments, activation of the actuator 401 causes the membrane 180 to deflect into the pumping chamber 174, reducing the volume of the pumping chamber 174 and forcing fluid out of the nozzle 126. The actuator 401 can be a piezoelectric actuator and can include a lower electrode 190, a piezoelectric layer 192, and an upper electrode 194. Alternatively, the fluid ejection element can be a heating element.

The integrated circuit interposer 104 includes transistors 202 (only one ejection device is shown in FIG. 5 and thus only one transistor is shown) and is configured to provide signals for controlling ejection of fluid from the nozzles 126. The substrate 122 and integrated circuit interposer 104 include multiple fluid flow paths 242 formed therein.

Figure 6:
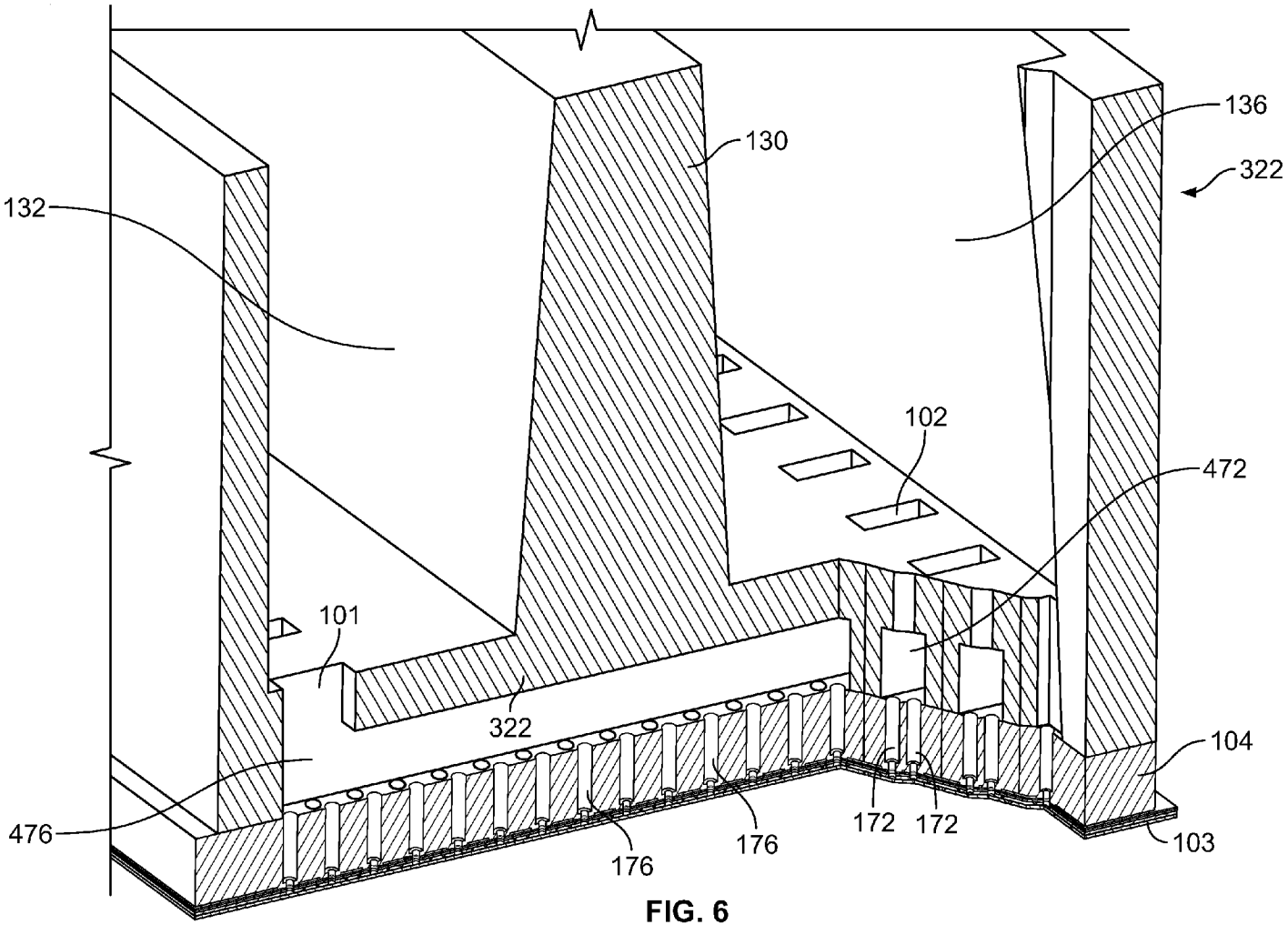
FIG. 6 is a perspective view of a portion of a printhead body.

Referring to FIG. 6, the fluid can flow from a fluid supply, e.g., one of the fluid containers 14*a*, 14*b* of FIG. 1, through the lower housing 322 of the printhead body 100 (FIG. 4), through the integrated circuit interposer 104, through the die 103, and out of the nozzles 126 in the nozzle layer 184. The lower housing 322 can be divided by a dividing wall 130 to provide an inlet chamber 132 and an outlet chamber 136. The fluid from the fluid supply can flow into the fluid inlet chamber 132, through fluid inlets 101 in the floor of the lower housing 322, through fluid inlet passages 476 of the lower housing 322, through the fluid paths 242 of the die 103, through fluid outlet passages 472 of the lower housing 322, out through the outlet 102, into the outlet chamber 136, and to the fluid return, e.g., the other one of the fluid containers 14*a*, 14*b* of FIG. 1. During fluid recirculation, the flow direction can also be opposite to what is described above. A portion of the fluid passing through the die 103 can be ejected from the nozzles 126.

Each fluid inlet 101 and fluid inlet passage 476 is fluidically connected in common to the parallel inlet channels 176 of a number of MEMS fluid ejector units, such as one, two or more rows of units. Similarly, each fluid outlet 102 and each fluid outlet passage 472 is fluidically connected in common to the parallel outlet channels 172 of a number of MEMS fluid ejector units, such as one, two or more rows of units. Each fluid inlet chamber 132 is common to multiple fluid inlets 101. And each fluid outlet chamber 136 is common to multiple outlets 102. The terms "inlet" and "outlet" do not indicate the flow directions. In other words, the fluid can be provided to the pumping chambers in the die 103 from the inlets 101 or from the outlets 102, depending on the flow direction between the two fluid supplies. Printhead modules are discussed in U.S. patent application Ser. No. 12/833,828, the entire content of which is incorporated herein by reference.

In other implementations, each fluid container 14*a*, 14*b* can include a fluid refill port so that the system 10 can be reused. For example, when the fluid in the containers is substantially used up, the same fluid can be refilled into the containers through the refill port. In some implementations, the used containers can be cleaned and a different fluid can be filled into the containers for test printing. The fluid container 14*a*, 14*b* can be the same as the chambers 22*a*, 22*b*. In other words, the fluid can be directly stored in the chambers 22*a*, 22*b* without the containers 14*a*, 14*b*. The pressure of the fluid in different chambers 22*a*, 22*b* can be similarly controlled using the pressure source 28 and the controller 26, as explained previously. The flow paths 24*a*, 24*b*, 24*c* each may correspond to multiple flow paths in implementations.

In other implementations, the fluid containers 14*a*, 14*b* do not include any sensing devices to determine the fluid levels in the containers. The system 10 can be programmed to stop printing when a full bag of fluid is emptied by recirculation and jetting. No fluid flows back from a second bag back to the emptied bag. Such a design can reduce the cost of the system 10. Generally, in this embodiment, one of the fluid containers, e.g., container 14*a*, is full and the other container, e.g., container 14*b*, is empty before jetting. To fully use the fluid contained in the fluid container 14*a*, the print head body 16 can be programmed to jet until no fluid is left in the fluid container 14*a*.

The fluid can include ink of various colors and properties. A food grade printing fluid can also be used. In some implementations, the fluid can also include non-image forming fluids. For example, three-dimensional model pastes can be selectively deposited to build models. Biological samples can be deposited on an analysis array. Circuitry forming materials can also be used.

All publications, patent applications, patents, and other references mentioned herein are incorporated by reference herein in their entirety.

Other embodiments are within the scope of the following claims.

What is claimed is:

1. A method for use in fluid jetting, the method comprising:

delivering a first portion of a fluid at a controlled flow rate along a first flow path from a first container to a second container, the first portion of the fluid in the first flow path passing by a second flow path in a printhead along a first direction, the second flow path fluidically connecting the first flow path to a nozzle such that a second portion of the fluid passing through the first flow path is delivered through the second flow path to the nozzle when the nozzle is ejecting the fluid delivered from the first container; and delivering a third portion of the fluid at a controlled flow rate along a third flow path from the second container to the first container, the third portion of the fluid in the third flow path passing by the second flow path in the printhead along a second direction opposite to the first direction, the second flow path fluidically connecting the third flow path to the nozzle such that a fourth portion of the fluid passing through the third flow path is delivered through the second flow path to the nozzle when the nozzle is ejecting the fluid delivered from the second container.

2. The method of claim 1, further comprising maintaining a pressure difference between an internal pressure of the first container and an internal pressure of the second container.

3. The method of claim 2, further comprising maintaining each internal pressure of the first and second containers to be lower than an atmospheric pressure.

4. The method of claim 3, wherein a pressure difference between the internal pressure of the first or the second container and the atmospheric pressure is maintained to be smaller than the pressure difference between the internal pressure of the first container and the internal pressure of the second container.

5. The method of claim 2, wherein the first and second containers are flexible and the pressure difference is maintained by applying different pressures to exterior surfaces of the flexible first and second containers.

6. The method of claim 1, further comprising sensing a fluid level in the first and second containers and selecting a fluid delivery direction from the first and second directions based on the sensed fluid level.

7. The method of claim 6, wherein delivering the fluid in the fluid delivery direction comprising adjusting internal pressures of the first and second containers.

8. An apparatus for use in fluid jetting, the apparatus comprising:

a printhead including a flow path and a nozzle in communication with the flow path, the flow path having a first end and a second end;

a first container fluidically coupled to the first end of the flow path, the first container having a first controllable internal pressure;

a second container fluidically coupled to the second end of the flow path, the second container having a second controllable internal pressure, the first container and the second container each being a self-contained fluid reservoir; and a controller to control the first controllable internal pressure and the second controllable internal pressure to have a fluid flow between the first container and the second container through the flow path in the printhead, at least a portion of a fluid flowing along the flow path is delivered to the nozzle when the nozzle is jetting, the first controllable internal pressure being higher than the second controllable internal pressure.

9. The apparatus of claim 8, wherein the first controllable internal pressure and the second controllable internal pressure are both lower than atmospheric pressure.

10. The apparatus of claim 8, wherein the first container is in a first chamber and the second container is in a second chamber, and the first and second containers are flexible and contain substantially no air.

11. The apparatus of claim 10, wherein each of the first and second chambers is connected to a vacuum source to provide adjustment to the first and second controllable internal pressures.

12. The apparatus of claim 8, wherein the first container contains the fluid and the second container is empty before use.

13. A method for use in fluid jetting, the method comprising:

flowing a fluid at a controlled flow rate from a first container through a flow path in a first flow direction, the flow path configured such that a first portion of the fluid flows from the first container to a second container and a second portion of the fluid flows from the first container to a nozzle when the nozzle is ejecting the fluid delivered from the first container; and reversing a direction of a flow of the fluid in the flow path such that the fluid flows from the second container through the flow path in a second flow direction opposite the first flow direction, the flow path configured such that a third portion of the fluid flows from the second container to the first container and a fourth portion of the fluid flows from the second container to the nozzle when the nozzle is ejecting the fluid delivered from the second container.

* * * * *